United States Patent [19]

Martin

[11] 4,102,076

[45] Jul. 25, 1978

[54] ACTION TOY

[75] Inventor: Herbert U. Martin, Chula Vista, Calif.

[73] Assignee: The Raymond Lee Organization, Inc., New York, N.Y. ; a part interest

[21] Appl. No.: 771,918

[22] Filed: Feb. 25, 1977

[51] Int. Cl.[2] ..... A63H 33/02

[52] U.S. Cl. ..... 46/220

[58] Field of Search ..... 46/220, 112, 114; D34/5 HP

[56] References Cited

U.S. PATENT DOCUMENTS

| | | | |
|---|---|---|---|
| 530,584 | 12/1894 | Eccleston | 46/114 |
| 3,611,624 | 10/1971 | Nieman | 46/220 X |
| 3,711,988 | 1/1973 | Summerfield | 46/114 |
| 3,939,603 | 2/1976 | Skinner | 26/220 X |

*Primary Examiner*—Louis G. Mancene
*Assistant Examiner*—Mickey Yu
*Attorney, Agent, or Firm*—Daniel Jay Tick

[57] ABSTRACT

A wheel has a rim of square cross-sectional area and a pair of diametrical struts intersecting each other at the center of the wheel. A rod has an elongated rod-like handle having spaced opposite first and second ends. The rod is adapted to be gripped at the first end. A cross-rod is affixed to the rod at the second end thereof and extends at right angles therewith to form a T-shape. Each of the outer circumference of the rim of the wheel and the cross-rod has flexible undulating material affixed thereto.

1 Claim, 5 Drawing Figures

ACTION TOY

BACKGROUND OF THE INVENTION

The present invention relates to an action toy.

Objects of the invention are to provide an action toy of simple structure, which is inexpensive in manufacture, and provides considerable amusement, exercise and interest to users.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
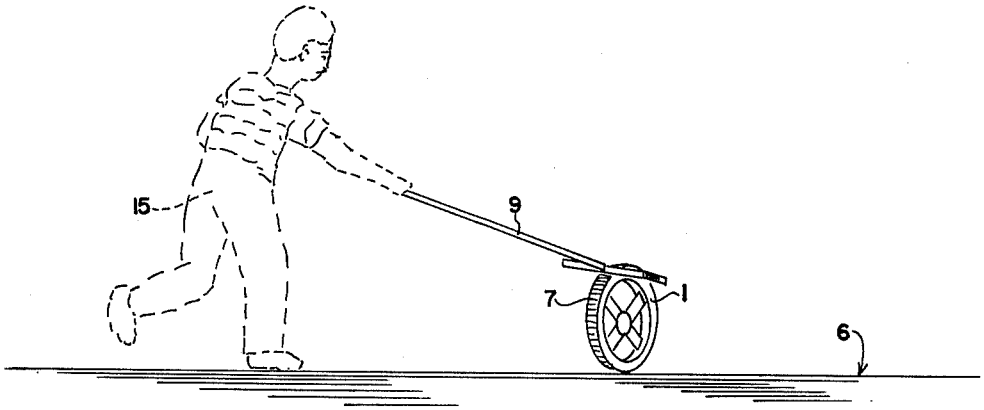
FIG. 1 is a perspective view of an embodiment of the action toy of the invention in use.

The action toy of the invention comprises a wheel 1 (FIGS. 1 and 4) having a rim 2 (FIGS. 4 and 5) of square cross-sectional area and a pair of diametrical struts 3 and 4 (FIGS. 4 and 5) intersecting each other at the center of the wheel. The rim 2 has an outer circumference 5 (FIG. 5) which rolls on a supporting surface 6 (FIG. 1).

Flexible material 7 (FIGS. 1 and 4) has an inner surface affixed to the outer circumference of the wheel and an undulating outer surface. The flexible material 7 comprises any suitable material such as, for example, rubber, plastic or the like.

Figure 4:
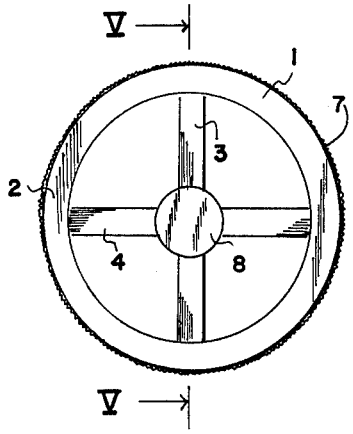
FIG. 4 is an axial view, on an enlarged scale of an embodiment of the wheel of the embodiment of FIG. 1.
Figure 5:
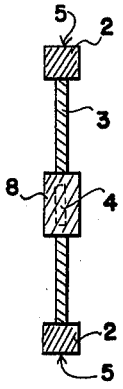
FIG. 5 is a cross-sectional view, taken along the lines V—V, of FIG. 4.

The wheel 1 has a cylindrical hub 8 (FIGS. 4 and 5).

Figure 2:
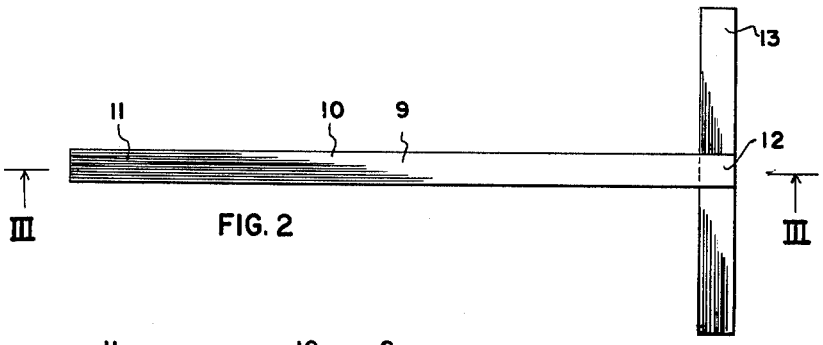
FIG. 2 is a top view, on an enlarged scale, of the rod of the embodiment of FIG. 1.
Figure 3:
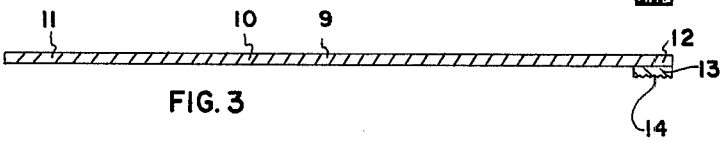
FIG. 3 is a cross-sectional view, taken along the lines III—III, of FIG. 2.

A rod 9 (FIGS. 1 to 3) has an elongated rod-like handle 10 (FIGS. 2 and 3) having spaced opposite first and second ends 11 and 12 (FIGS. 2 and 3). The handle 10 is adapted to be manually gripped at the first end 11.

A cross-rod 13 (FIGS. 2 and 3) is affixed to the handle 10 at the second end 12 thereof and extends at right angles therewith to form a T-shape.

Flexible material 14 (FIG. 3) has an inner surface affixed to the cross-rod 13 and an undulating outer suface contacting the undulating outer surface 7 of the circumference 5 of the wheel 1 in part when a user 15 rolls the wheel via the cross-rod, as shown in FIG. 1.

The flexible material 7 affixed to the wheel has undulations extending at right angles to circles around the outer circumference 5 of the wheel, as shown in FIG. 1. The flexible material 14 affixed to the cross-rod 13 has undulations extending in the same directions as the undulations of the circumference of the wheel, as shown in FIG. 3. Thus, part of the surface 7 of the circumference 5 of the wheel is gripped by part of the surface 14 of the cross-rod 13 when the user rolls the wheel via the cross-rod. This provides suitable friction between the cross-rod 13 and the wheel 1.

While the invention has been described by means of a specific example and in a specific embodiment, I do not wish to be limited thereto, for obvious modifications will occur to those skilled in the art without departing from the spirit and scope of the invention.

I claim:

1. An action toy, comprising a wheel having a rim and a pair of diametrical struts intersecting each other at the center of the wheel, the rim having an outer circumference which rolls on a supporting surface;

flexible material having an inner surface affixed to the outer circumference of the wheel and an undulating outer surface, the flexible material affixed to the wheel having undulations extending at right angles to circles around the outer circumference of said wheel;

a rod having an elongated rod-like handle having spaced opposite first and second ends, adapted to be manually gripped at the first end;

a cross-rod affixed to the handle at the second end thereof and extending at right angles therewith to form a T-shape; and flexible material having an inner surface affixed to the cross-rod and an undulating outer surface contacting the undulating outer surface of the circumference of the wheel in part when a user rolls the wheel via the cross-rod, the flexible material affixed to the cross rod having undulations extending in the same direction as the undulations of the circumference of the wheel whereby part of the surface of the circumference of the wheel is gripped by part of the surface of the cross-rod when the user rolls the wheel via the cross-rod.

* * * * *